United States Patent [19]

Dunning et al.

[11] Patent Number: 4,781,311

[45] Date of Patent: Nov. 1, 1988

[54] ANGULAR POSITIONED TRIGGER SPRAYER WITH SELECTIVE SNAP-SCREW CONTAINER CONNECTION

[75] Inventors: Walter B. Dunning; George E. Campbell, both of Pleasanton; Julio Focaracci, Oakland, all of Calif.

[73] Assignee: The Clorox Company, Oakland, Calif.

[21] Appl. No.: 55,247

[22] Filed: May 28, 1987

Related U.S. Application Data

[63] Continuation-in-part of Ser. No. 890,883, Jul. 28, 1986, abandoned, which is a continuation of Ser. No. 642,068, Aug. 17, 1984, abandoned.

[51] Int. Cl.[4] ..... B67B 5/00; B65D 83/14

[52] U.S. Cl. ..... 222/153; 215/318; 215/330; 222/321; 222/383; 222/562

[58] Field of Search ..... 222/153, 321, 383, 549, 222/550, 562; 215/316–318, 329–331, 31, 206, 217, 220, 222, 321, 332, 337

[56] References Cited

U.S. PATENT DOCUMENTS

| | | | |
|---|---|---|---|
| 2,886,219 | 5/1959 | Van Baarn | 222/545 X |
| 3,165,220 | 1/1965 | Haynes | 215/318 |
| 3,223,269 | 12/1965 | Williams | 215/318 |
| 3,261,513 | 7/1966 | Moran | 222/519 |
| 3,420,413 | 1/1969 | Corsette | 222/321 X |
| 3,531,008 | 9/1970 | Achabal et al. | 215/220 |
| 3,794,200 | 2/1974 | Marks | 215/318 X |
| 3,822,027 | 7/1974 | Cherba | 215/329 X |
| 3,907,146 | 9/1975 | Fields | 215/317 |
| 3,910,444 | 10/1975 | Foster | 215/318 X |
| 4,071,156 | 1/1978 | Lowe | 215/206 X |
| 4,103,798 | 8/1978 | Moeller | 215/305 |
| 4,230,277 | 10/1980 | Tada | 239/333 |
| 4,298,129 | 11/1981 | Stull | 215/318 X |
| 4,373,641 | 2/1983 | Banich, Sr. et al. | 215/331 |
| 4,387,818 | 6/1983 | Conti | 215/31 X |
| 4,434,915 | 3/1984 | Kirk, Jr. | 222/153 |
| 4,454,965 | 6/1984 | Kirk, Jr. | 222/153 |
| 4,519,518 | 5/1985 | Wiles et al. | 215/331 |
| 4,538,745 | 9/1985 | Dunning et al. | 222/153 |
| 4,591,063 | 5/1986 | Geiger | 215/330 |
| 4,597,501 | 7/1986 | Gueret | 215/330 |

FOREIGN PATENT DOCUMENTS 2385600 10/1978 France .

*Primary Examiner*—Kevin P. Shaver

*Attorney, Agent, or Firm*—Majestic, Gallagher, Parsons & Siebert

[57] ABSTRACT

A cap and container especially suited for dispensing liquids has a cap which is accurately aligned upon closure. The container is closed by applying downward axial pressure to the cap, thereby forcing lugs in the cap to pass over threads located on the neck of the container so that the cap is snapped on. Stop walls prevent any undesired cap rotation. Stabilizing lugs are alternatively provided to add additional stability. Alternatively, the container is closed by twisting or rotating the cap with respect to the neck. The cap may also be twisted or snapped off. Modifications in the neck configuration make the cap irremovable.

10 Claims, 5 Drawing Sheets

ANGULAR POSITIONED TRIGGER SPRAYER WITH SELECTIVE SNAP-SCREW CONTAINER CONNECTION

This is a continuation-in-part of U.S. Patent Application Ser. No. 890,883 filed July 28, 1986, now abandoned which is a continuation of U.S. Patent Application Ser. No. 642,068 filed Aug. 17, 1984 now abandoned.

TECHNICAL FIELD

This invention relates to cap and container closure configurations for opening and closing containers and more specifically to configurations which require accurate alignment of the cap with the container.

BACKGROUND OF THE INVENTION

Accurate alignment of closure configurations in packaging is required for various operations such as to control the opening of containers with safety caps or to ensure the proper operation of liquid dispensing mechanisms attached to or incorporated in caps or bottles. U.S. Pat. No. 3,261,315 is an example of a closure configuration where specific alignment of the cap closure is required for the dispensing of liquids. Also of concern in closure configurations is the method used to open and close the containers such as axial snapping on and off or twisting and untwisting. Consumers are familiar with the rotatable motion for closing or removing caps, and therefore with reusable containers a twisting or untwisting capability is most desirable. However, in regard to the closing of containers by automated machines, a simple axial snap-on movement in which the closure is aligned with respect to the container is preferable. In addition, no rotational motions are required which makes for simplified, automated assembly. Also, for some people with physical handicaps, a twisting motion is impossible, while a snap-on, snap-off motion is not. Therefore, the ideal cap is one which is versatile enough to provide the ability to use either method for opening and closing. U.S. Pat. No. 3,223,269 discloses a cap which may be snapped on and then removed and replaced by the same rotatable motion that is a feature of all screw caps. Other snap-on or twist-off caps are described in U.S. Pat. Nos. 4,298,129 and 3,910,444.

Unfortunately, none of the aforementioned prior art closure configurations incorporate the versatility of the combined opening and closing methods with ensured, accurate alignment. In addition, none of these prior cap closures provide the advantage of being able to be snapped off as well as snapped on and twisted off and on.

Other important considerations in packaging are the production costs and design efforts involved in manufacturing different moldings. A cap which may be used interchangeably both as a removable or irremovable closure is also highly advantageous. This is especially so when such a design configuration still provides accurate alignment and only requires changes in the container neck moldings to be either removable or irremovable.

SUMMARY AND DISCLOSURE OF THE INVENTION

One aspect of the invention is a cap closure that incorporates a snap-on, snap-off, twist-on, twist-off opening and closing mechanism and also provides accurate alignment of the cap closure with respect to the container.

A second aspect of the invention is to provide a novel cap closure configuration which has a minimum of parts while still performing the same functions and is therefore less costly to produce.

A third aspect of the invention is to provide a refillable container and closure which is particularly suited for dispensing liquids by means of a trigger spray mechanism.

Another aspect of the invention is a container cap closure which may be accurately aligned with the neck of the container and, depending on the neck molding, is either removable or irremovable from the container.

These aspects are accomplished by a unique cap closure and varied neck configurations comprising a container with a neck having an inner bore and either external threads or an external annular bead fastener, and vertical stops or walls. A cap closure having an outer annular skirt having inwardly projecting lugs adapted to pass over the threads or bead fastener with axial pressure and to abut the walls upon closure while an annular inner skirt seals the inner bore is provided.

The cap material may be rigid or resilient, but the lugs must be so designed as to spring past the threads or bead fastener when the cap is applied to the neck using axial pressure. When the lugs and cap are made from a rigid material, the material for the threads or bead fastener must be yieldable.

The cap closure can be snapped on and off and twisted on and off when the fastening means are external threads and the walls are located diametrically opposite each other so that they abut the lugs in opposite directions relative to the neck. Upon closure, the top side of each lug interfaces with the under surface of the external threads. Depending on the extent of the interfacing (i.e. not more than $\frac{2}{3}$ of the width of each lug's top side), the cap may also be snapped off.

In a second embodiment the fastening means is an annular bead and the interface or engagement between the bead and the lugs is substantially the width of the lugs' top sides and the walls on the neck abut the lugs in the same direction relative to the neck, the cap closure is irremovable and unyieldingly aligned. In yet another embodiment similar to the first embodiment an additional pair of oppositely facing lugs are provided intermediate the inwardly projecting lugs as will be more fully described hereinafter.

DESCRIPTION OF THE PREFERRED EMBODIMENT

Figure 3:
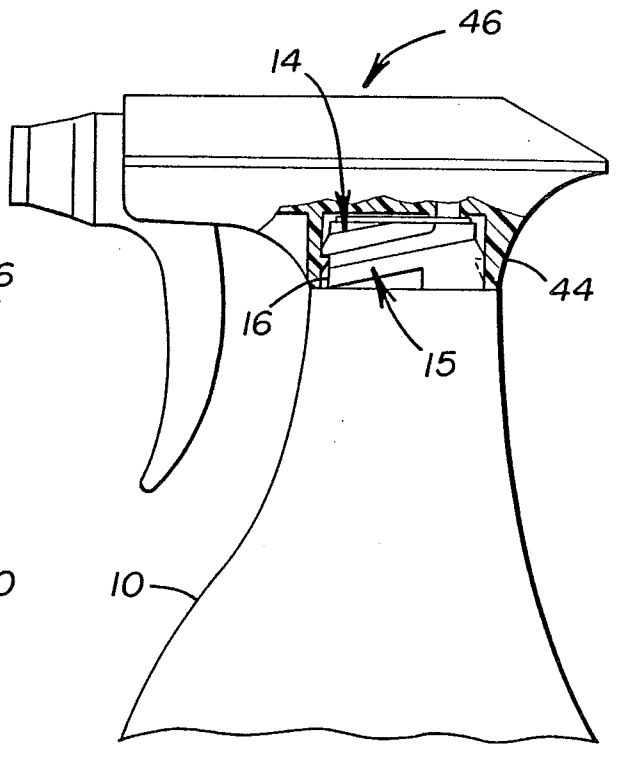
FIG. 3 shows a fragmentary right side elevational view partially in axial section of the device shown in FIG. 1.
Figure 2:
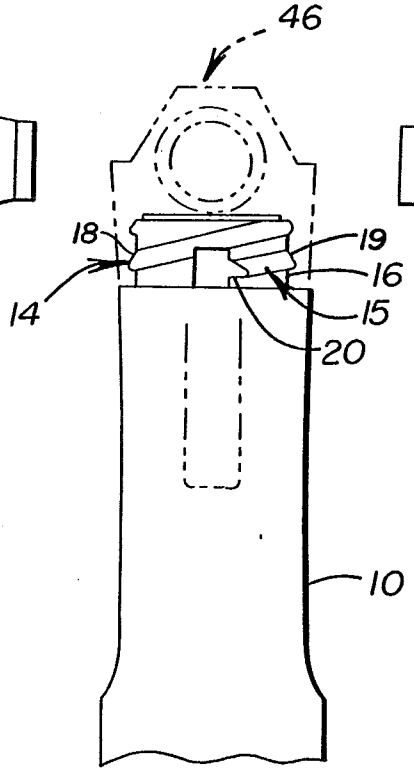
FIG. 2 is a front elevational view of the container of FIG. 1 showing thread details.
Figure 1:
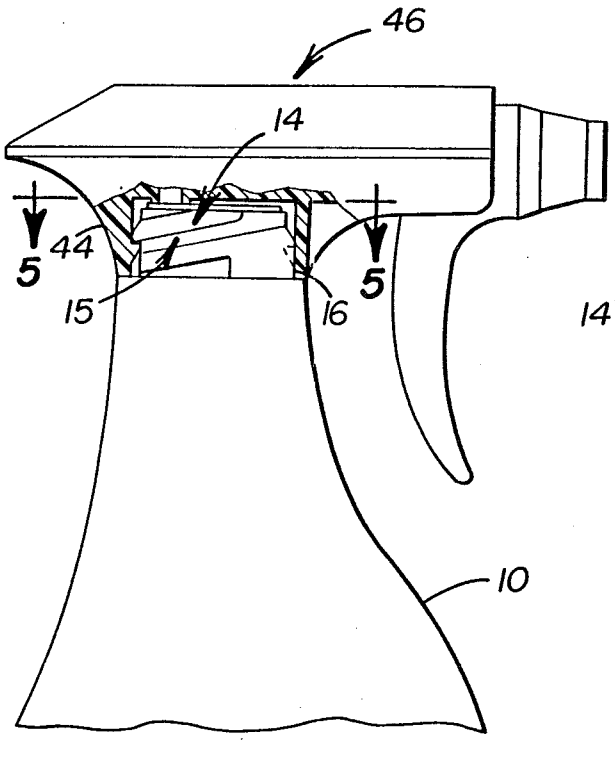
FIG. 1 is a fragmentary left side elevational view of a first embodiment of a container showing neck details as well as a trigger spray type cap closure in phantom.
Figure 4:
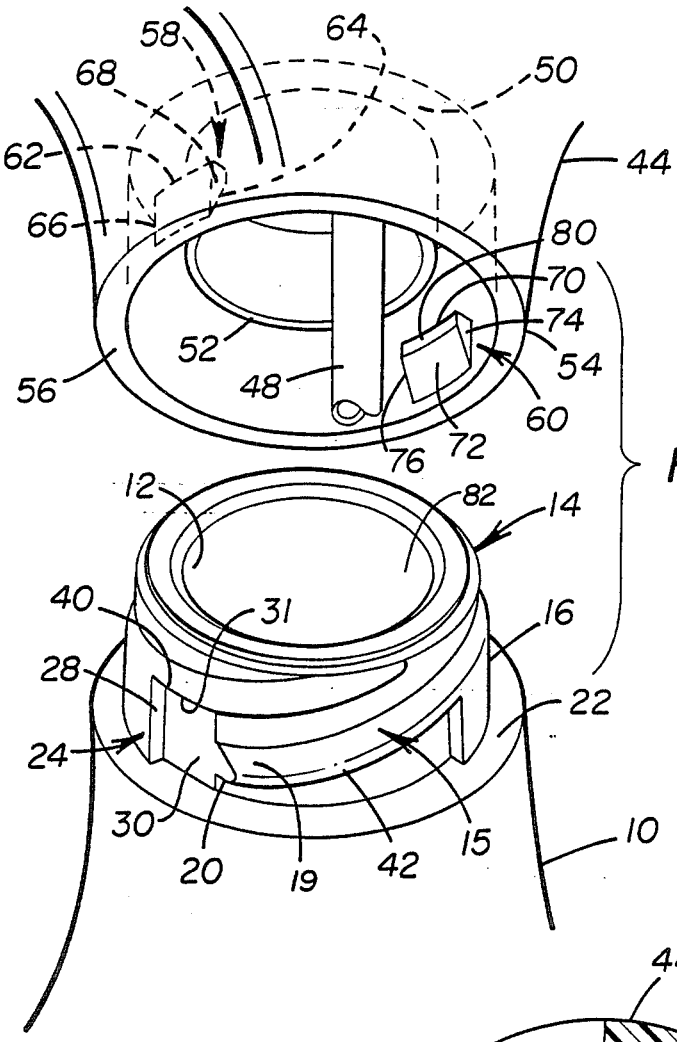
FIG. 4 is an exploded isometric view of the container and cap closure showing details of the inner skirt of the cap closure and of the container neck.

FIGS. 1-4 show a container 10 having an open end including inner bore 12, with a neck 16 and a pair of concentric external threads 14 and 15. The upper surface 18 of the thread 14 slopes downward and outward at an angle to the axis defined by the neck 16, while the under surface 20 is generally perpendicular to the neck axis as best seen in FIG. 2. Similarly, thread 15 has an upper sloping portion 19 and a lower surface 21. Below the threads 14, 15 at the base of the neck 16 is a flat annular shoulder 22.

Figure 7:
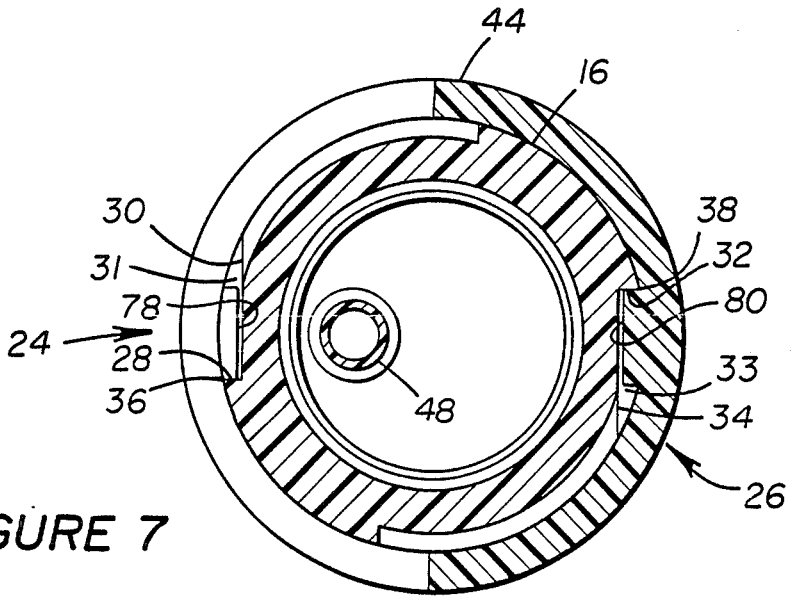
FIG. 7 is a sectional view along lines 7—7 in FIG. 6 showing details of the alignment mechanism.
Figure 5:
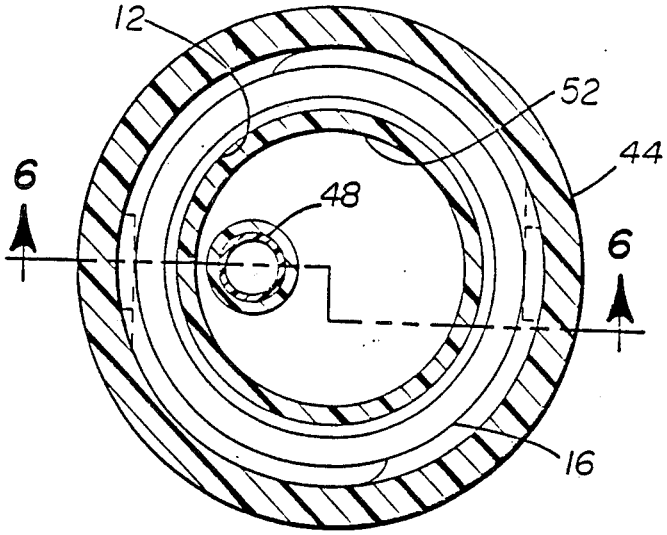
FIG. 5 is a sectional view taken along the line 5—5 in FIG. 1.
Figure 6:
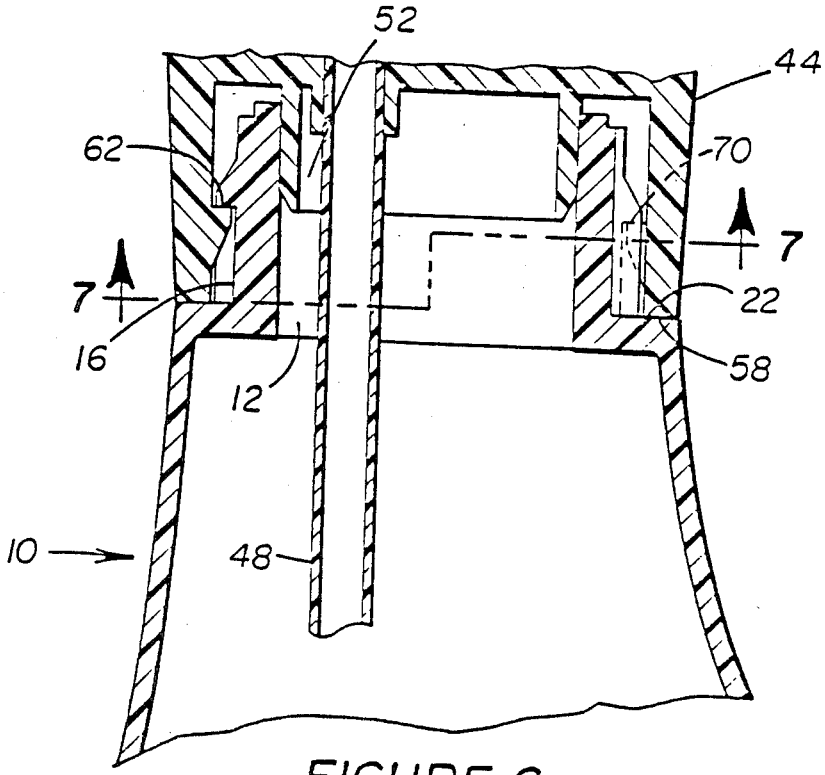
FIG. 6 is a revolved section along lines 6—6 in FIG. 5.

Respectively located between the first thread 14 and the shoulder 22 and the second thread 15 and the shoulder 22 are grooves 24, 26. Groove 24 is formed by first and second vertical walls 28, 30 and horizontal wall 31. Similarly, groove 26 is formed by first and second vertical walls 32, 34 and horizontal wall 33 as seen in FIG. 7.

The outer edges 36, 38 of the walls 28, 32, respectively, are preferably coextensive and continuous with the outer rim 40, 42, respectively, of the external threads 14, 15. In this particular embodiment the walls 28, 32 are, in respect to the neck bore 16, on opposite sides and face in opposite directions. Adjacent each wall on opposite sides of the neck are flattened surfaces 30, 34 which provide stability.

The container 10 is provided with a cap closure 44 for sealing the inner bore 12 and accurately aligning the neck 16 with the cap 44. As shown in the Figures, a preferred embodiment of the cap closure incorporates a trigger spray dispensing mechanism shown generally at 46 with a depending flexible tube 48. In order for the trigger spray 46 to operate properly, the cap 44 and the neck 16 must be accurately aligned. This is due to the fact that the container may advantageously be shaped to fit the hand and therefore takes on an orientation that must be accurately matched to the orientation of the trigger spray 46 on the cap closure 44. The cap has a closed end wall 50, a resiliently flexible inner annular skirt 52 depending from the closed end wall 50 and an outer annular skirt 54 which is in coaxial, spaced relation to inner skirt 52. The outer skirt 54 includes a bottom rim 56, a first radially inwardly projecting lug 58, and a second radially inwardly projecting lug 60. Lug 58 has a top 62, front (unshown), first lateral 66 and second lateral 68 sides. Similarly, opposite lug 60 has a top 70, front 80, first lateral side 74, and second lateral side 76. The lugs have horizontal top surfaces 62, 70 that bear against horizontal walls 31, 33, respectively of the neck 16. Also, lugs 58, 60 have beveled areas 64, 72 which are adapted to ride over the threads as will be more fully described hereinafter.

The container 10 may be initially closed by inserting the tube 48 into the container 10, aligning the lugs 58, 60 vertically with the grooves 24, 26 and axially forcing the lugs downward past the upper surfaces 18, 19 of the yieldable threads 14, 15 until the top sides 62, 70 of the lugs 58, 60 engage the under surfaces 20, 21 of the threads 14, 15 and the bottom rim 56 engages the shoulder 22. The first lateral sides 66, 74 of the lugs 58, 60 will be brought to bear against the vertical walls 28, 30 of the grooves 24, 26, respectively, thereby preventing any rotation in a clockwise direction. This is important to ensure the proper operation of the trigger spray mechanism 46.

Upon full advancement of the inner skirt 52, the outside diameter of which is slightly larger than the diameter of the inner bore 12, the skirt 52 is also thereby radially fitted against the surface of the inner bore 12 to seal the container 10 and prevent axial tilting forces between the cap 44 and the container 10.

The container 10 may also be closed by twisting the cap in a clockwise direction until the first lateral sides 66, 74 of the lugs 58, 60 abut the walls 28, 30 of the grooves 24, 26, respectively. It should be noted that the rim 56 substantially engages the shoulder 22 upon closure. Such engagement, however, is not necessary as proper closure and alignment is ensured by the engagement of the seal between skirt 52 and surface of inner bore 12.

The container may be opened by rotating the cap 44 in a counterclockwise direction. Also, the structural interfacing between the threads 14, 15 and lugs 58, 60 is such that when strong upward axial pressure is applied directly and alternatingly under each of the lugs, the cap may also be removed by snapping it off.

Figure 9:
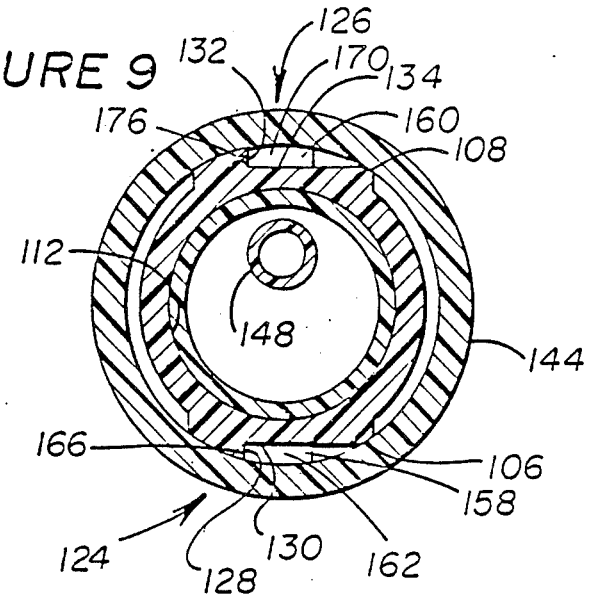
FIG. 9 is a sectional view along 9—9 in FIG. 8.
Figure 8:
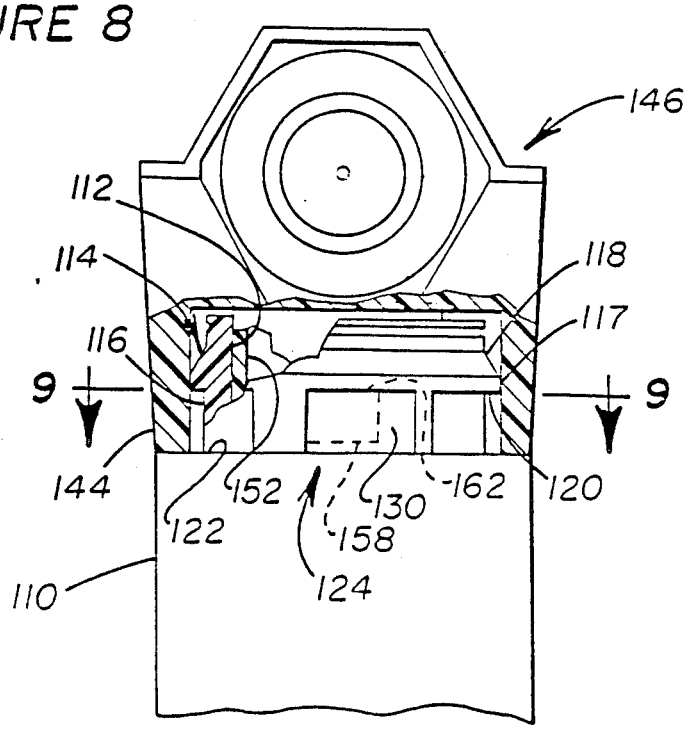
FIG. 8 is a fragmentary front elevational view in partial section of a second embodiment of the invention.

Turning to FIGS. 8 and 9, a second embodiment of the invention is shown wherein structure having a counterpart in the aforedescribed first embodiment is identified by adding a one (1) before the number. With this embodiment, the cap is the same as before, but the screw thread fastening means 14, 15 has been replaced by an annular bead 114 having an axially directed front surface 117, a radially directed flat under surface 120 and an upper surface 118 that tapers downward and radially outward. Located between the bead 114 and the shoulder 122 are grooves 124, 126 having a first vertical wall 130 and a second vertical wall 134 and vertical walls 128, 132 facing in the same direction with regard to the neck 116. The neck 116 also includes vertical protrusions 106, 108 which simplify the tooling required for this particular neck configuration. To close the container 110 in FIGS. 8 and 9 the lugs 158, 160 must be forced over the bead 114 so that the inner skirt 152 will again seal the container by fitting against the inner bore 112 and the first lateral side 166 of the first lug 158 will engage the first wall 128, and the first lateral side 176 of the second lug 160 will engage the second wall 132.

Unlike the previous embodiment, deliberate or accidental removal of the cap is impossible without completely destroying the cap closure. This is due to the full engagement of the lug top sides 162, 170 with the flat undersurface 120 of the annular bead 114. Twisting of the cap is impossible because of the abutment arrangement of the lugs 158 and 160 with the walls 128 and 132, respectively. With this arrangement, the walls 128 and 132 both face in the same direction thereby preventing rotation of the cap 144. This abutment also permanently locks the neck 116 and the cap 144 in the desired alignment. Axial removal is prevented by the interfacing of the under surface 120 of the bead 114 with substantially the entire width of top sides 162, 170 of the lugs 158 and 160. The flatness of the under surface 120 plus the sharp angle between the under surface 120 and the front surface 117 also aid in preventing the removal of the cap 144 by upward axial pressure.

Figure 10:
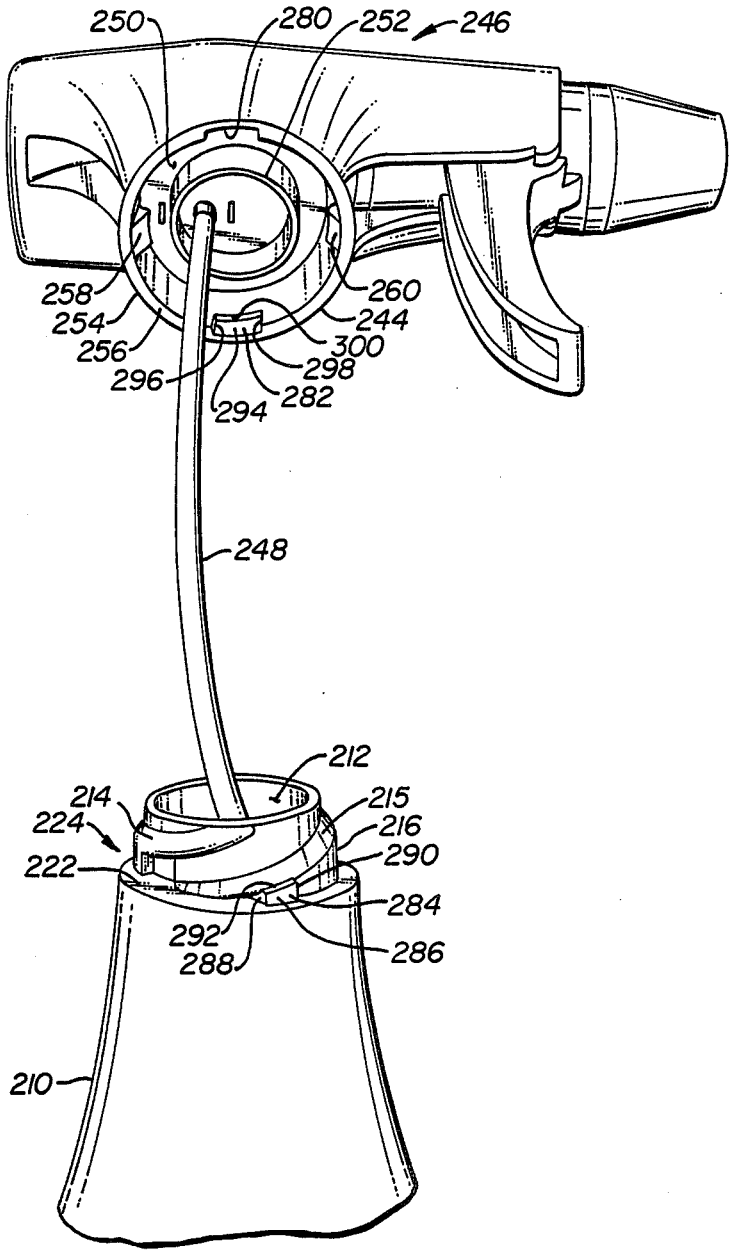
FIG. 10 is an exploded isometric view of another embodiment similar to the first embodiment with the bottle portion partially rotated and illustrating details thereof.

Turning now to FIG. 10, there is shown another embodiment similar to the first embodiment. As with the first embodiment, the container 210 is provided with a cap closure 244. The cap closure is a part of and dependent from a trigger spray mechanism shown generally at 246 with its depending flexible tube 248.

The cap closure includes a closed end wall 250 having an inner annular skirt 252 depending therefrom. Inner annular skirt 252 is dimensioned so as to closely fit and seal within bore 212 within neck 216 of container 210. Outer annular skirt 254 is in coaxial spaced relationship with inner annular skirt 252. As before, the neck includes a pair of concentric external threads 214 and 215. The outer skirt includes a bottom rim 256, a first radially inwardly projecting lug 258, and a second inwardly projecting lug 260 diametrically opposite the first lug.

Intermediate the first and second lugs are a pair of diametrically opposed recesses 280, 282. The recesses are located equidistant between lugs 258, 260. These recesses cooperate with a pair of stabilizing lugs, one of which is shown at 284 on neck 216 of container 210. Each of these lugs extends upwardly from shoulder 222 and has a curved radially outermost wall 286 bounded laterally by a pair of vertical, lateral side walls 288, 290. These walls 286, 288, 290 all extend vertically to a ramp or beveled top surface 292 having an angle which is coextensive with the angle that second thread 215 makes with respect to the horizontally directed shoulder 222. Similarly, the other stabilizing lug (not shown) relates to the first thread 214.

Each of recesses 280, 282 is dimensioned so as to accommodate a respective stabilizing lug. For example, recess 282 includes a curved radially outermost, vertical wall 294 which corresponds and mates with wall 286. Generally parallel vertical side walls 296, 298 correspond and mate with walls 288, 290 respectively. Finally, beveled top wall 300 corresponds and mates with top surface 292. The stabilizing lugs function in concert with their accommodating recesess 280, 282 to add additional stability to the trigger sprayer 246 when it is mounted on container 210.

It is to be understood that while the invention has been described above in conjunction with the preferred specific embodiment and alternate embodiments thereof, that the description is intended to illustrate and not limit the scope of the invention, which is defined by the scope of the appended claims.

We claim:

1. A container and cap closure therefor comprising:

(a) a container having a generally cylindrical neck including a bore therethrough for dispensing liquids;

(b) a cap closure for closing said bore including a closed end and an outer annular skirt depending therefrom and adapted to fit over said neck; and (c) retaining means on said neck and skirt permitting said cap closure to be snapped on and off as well as rotated on and off said neck, said retaining means comprising:

(i) at least one thread on said neck; and (ii) at least one retaining lug having a horizontal top surface on the interior of said skirt having a beveled area at the bottom tapering substantially to the innermost edge of said top surface adapted to ride over said thread when snapped onto said neck, said skirt and retaining lug being made of resilient material so that they may deform as they pass over said thread when said cap closure is snapped on or off said neck;

(iii) at least one retaining groove on said neck, said at least one retaining lug cooperating with said at least one retaining groove and said thread so as to axially retain said cap closure on said neck; and (d) positioning means on said neck for positioning said cap closure with respect to said neck whereby said cap closure will be automatically positioned in the same orientation on said neck when said cap closure is fully engaged; and (e) stabilizing means comprising at least one stabilizing recess in said cap closure, at least one mating stabilizing lug on said neck adapted to closely fit within said at least one stabilizing recess for stabilizing and orienting said cap closure with respect to said neck, said at least one stabilizing lug spaced about 90° around said neck from said at least one retaining groove so as to maximize the stabilizing effect, wherein said at least one stabilizing lug defines a generally curved radially outermost wall bounded laterally by a pair of generally vertical, lateral side walls.

2. The invention of claim 1 further including a trigger spray mechanism mounted on said cap closure, and a tube depending from said cap closure adapted for communicating said container with said trigger spray mechanism through said bore in said neck.

3. The invention of claim 1 further including an inner annular skirt depending from said cap closure in concentric spaced relation within said outer skirt and adapted to fit within and seal said bore.

4. The invention of claim 1 wherein said thread is made of resilient material so that it may deform when said lug passes over it as said cap closure is snapped on or off said neck.

5. The invention of claim 1 wherein said positioning means comprises a generally axially directed wall in said at least one retaining groove, said wall being cooperable with a corresponding wall on said at least one retaining lug so as to prevent rotation of said cap closure with respect to said neck when said at least one retaining lug is positioned within said groove.

6. The invention of claim 5 wherein the number of threads is two, said threads being in concentric, helical relation with each other.

7. The invention of claim 6, wherein the number of at least one retaining lugs and accommodating retaining grooves is two, the first of said at least one retaining lugs being positioned generally opposite to the second of said at least one retaining lugs within the interior of said skirt, and wherein the first of said at least one retaining grooves is correspondingly positioned opposite the second of said at least one retaining grooves.

8. The invention of claim 1 further including a beveled top surface joining said radially outermost and said lateral side walls of said at least one stabilizing lug.

9. The invention of claim 8 wherein the number of at least one retaining lug is two positioned so as to be diametrically opposite to each other on the interior of said skirt, and wherein each of said stabilizing recesses is located on said skirt intermediate each of said retaining lugs.

10. The invention of claim 9 wherein the number of stabilizing lugs is two, said stabilizing lugs being positioned diametrically opposite to each other.

* * * * *